United States Patent [19]

Matthews et al.

[11] Patent Number: 4,856,139

[45] Date of Patent: Aug. 15, 1989

[54] VACUUM CLEANER UPPER HOSE ASSEMBLY

[75] Inventors: James A. Matthews; Louis A. Rotola, Jr., both of Anderson, S.C.

[73] Assignee: Ryobi Motor Products Corp., Pickens, S.C.

[21] Appl. No.: 304,466

[22] Filed: Feb. 1, 1989

[51] Int. Cl.[4] ..... A47L 9/14

[52] U.S. Cl. ..... 15/350

[58] Field of Search ..... 15/350, 351, 334

[56] References Cited

U.S. PATENT DOCUMENTS 2,898,622 8/1959 Hurd ..... 15/334 X
3,634,905 1/1972 Boyd ..... 15/350
4,364,146 12/1982 Bowerman ..... 15/351 X
4,670,937 6/1987 Sumerau et al. ..... 15/329
4,720,887 1/1988 Bosyj et al. ..... 15/351
4,748,713 6/1988 Sepke et al. ..... 15/351 X

*Primary Examiner*—Chris K. Moore
*Attorney, Agent, or Firm*—David L. David

[57] ABSTRACT

An upper hose assembly for an upright vacuum cleaner is arranged with external threads at one end for connection into the dirt collecting portion intake duct while the other end of the hose has mounted thereon a connector which allows for a snap-fit connection/disconnection from the fan discharge port of the vacuum cleaner. The connector is designed to provide a retrofit adaptation to an existing vacuum cleaner.

8 Claims, 4 Drawing Sheets

VACUUM CLEANER UPPER HOSE ASSEMBLY

BACKGROUND OF THE INVENTION

This invention relates to upright vacuum cleaners and, more particularly, to an upper hose assembly for such a vacuum cleaner.

Upright vacuum cleaners generally comprise a head portion including a motor driven fan for producing suction and a suction inlet nozzle in fluid communication with the fan. The head is typically provided with wheels for movable support on a floor surface to be cleaned. A handle is usually pivotally mounted to the cleaner head so that the operator may control movement of the vacuum cleaner along the floor surface. The cleaner head includes a fan discharge port for discharging dirt laden air collected from the floor surface as a result of the suction produced by the fan and the handle typically supports a dirt collecting container, such as a disposable filter bag or the like, to which the dirt laden air is directed for collection therein of the dirt. Accordingly, a conduit must be provided from the fan discharge port to an intake port of the dirt collecting container. Since the dirt collecting container is mounted on the handle which in turn is pivotally mounted on the cleaner head, there will be relative movement between the fan discharge port of the cleaner head and the intake port of the dirt collecting container. Therefore, the conduit between these two ports must be capable of accommodating such movement.

In the past, a flexible hose has been used as the conduit. In particular, such hose has been constructed as an undulating bellows so that it can both bend and change in length to adapt for the changing spatial relationship between the discharge and intake ports. U.S. Pat. No. 4,670,937 shows such a flexible bellows hose installed in a vacuum cleaner which may be operated in an upright mode. Specifically, although not disclosed in full detail in the referenced patent, the intake port includes an internally threaded intake duct and the upper end of the hose is formed with an external spiral rib extending a sufficient distance from that upper end and of appropriate pitch to act as an external thread for matingly engaging the upper end of the hose with the intake duct. The fan discharge port includes a rigid tube stub having a circumferential rib and in order to attach the hose thereto the lower end of the hose is forced over the stub so that the rib engages one of the undulations of the hose. This is done at the time of assembly of the vacuum cleaner in the manufacturing facility, the hose being adapted for permanent installation in this manner. However, the hose is of reduced dimension relative to the suction inlet nozzle of the cleaner head so that items picked up by the vacuum cleaner can become lodged in the reduced diameter hose and trapped by the undulations therein. This sometimes results in a clogging of the hose, making the vacuum cleaner inoperative for its intended purpose. To clear such a blockage, the operator has been forced to make a difficult manual manipulation of the hose to unthread it at its upper end and forcibly remove it from its engagement at its lower end. Some operators have been unable to effect such manipulation while others have damaged the hose during its removal and subsequent reinstallation.

Accordingly, it is a primary object of this invention to provide an improved hose assembly which is more readily adaptable for operator manipulation in removal and installation thereof.

It is another object of this invention to provide such an assembly which, when installed, is securely engaged and not subject to inadvertent removal.

It is a further object of this invention to provide such an assembly which may be retrofit onto the existing vacuum cleaner construction so that it can readily replace hoses on previously manufactured cleaners.

SUMMARY OF THE INVENTION

The foregoing and additional objects are attained in accordance with the principles of this invention by providing for a vacuum cleaner and hose as described above, a connector mounted on the lower end of the hose, the connector being formed of a plastic material and having a hollow cylindrical stub portion sized to fit within the lower end of the hose. An external circumferential rib on the stub portion engages a bellows undulation of the hose so as to secure the stub portion within the hose. Latching means are provided for removably securing the connector to the cleaner head so that the fan discharge port is in fluid communication with the connector stub.

In accordance with an aspect of this invention, the latching means includes a circumferential rib on the fan discharge port, a shoulder formed on the vacuum cleaner head adjacent the fan discharge port, groove means formed on the connector for engaging the circumferential rib so as to allow transverse movement of the connector relative the fan discharge port while preventing axial movement of the connector when fluid communication between the fan discharge port and the connector stub is achieved, and detent means formed on the connector for cooperating with the shoulder to inhibit the transverse movement.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
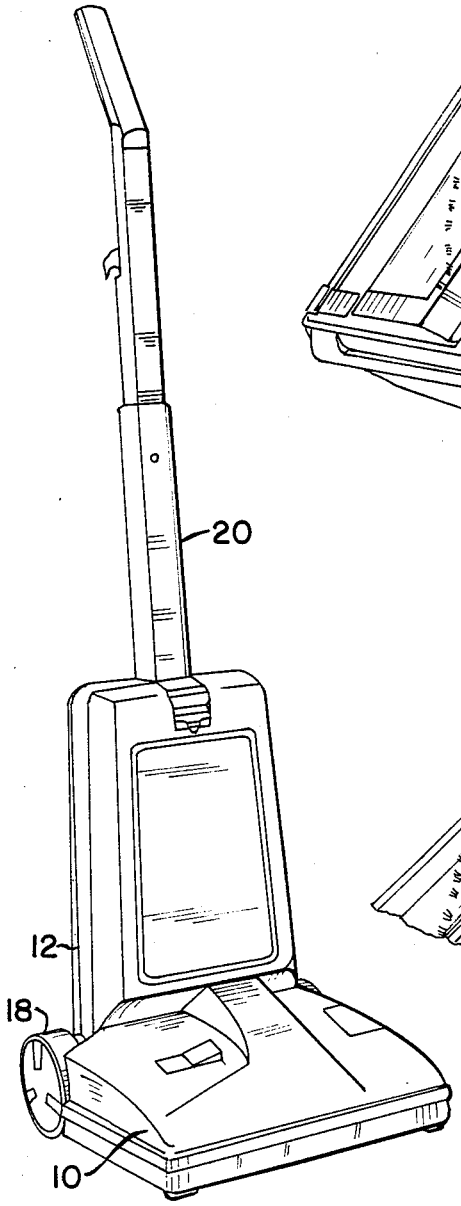
FIG. 1 is a front perspective view of an illustrative vacuum cleaner of the type in which the present invention may be utilized.

FIG. 1 illustrates a vacuum cleaner in which an arrangement constructed in accordance with the principles of this invention finds utility. The vacuum cleaner shown in FIG. 1 includes a head portion 10 and a dirt collecting portion 12. As is conventional, installed within the cleaner head portion 10 is a motor driven fan for producing suction. The fan communicates with a suction inlet nozzle 14 on the underside of the head portion 10 in which is fitted a driven brush roller 16. Wheels 18 are rotationally supported on or adjacent the pivotal connection between the head portion 10 and the dirt collecting portion 12. A handle 20 is supported on the dirt collecting portion 12 for operator controlled movement of the vacuum cleaner along a floor surface to be cleaned. For further details of construction of the vacuum cleaner shown in FIG. 1, the reader is referred to the aforenoted U.S. Pat. No. 4,670,937.

Figure 2:
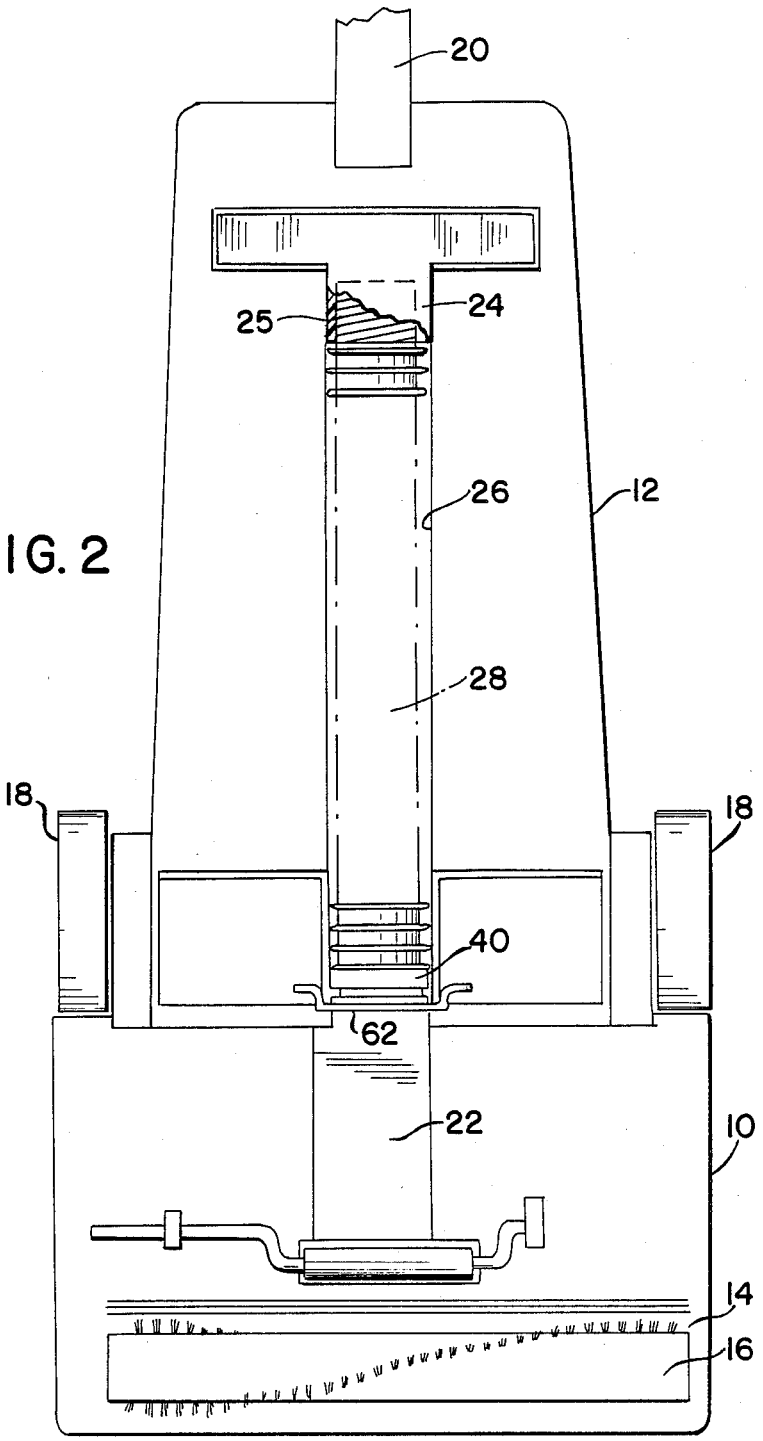
FIG. 2 is a bottom and rear view of the cleaner head and dirt collecting portions, respectively, of the vacuum cleaner of FIG. 1, showing an assembly according to the present invention installed therein.
Figure 5:
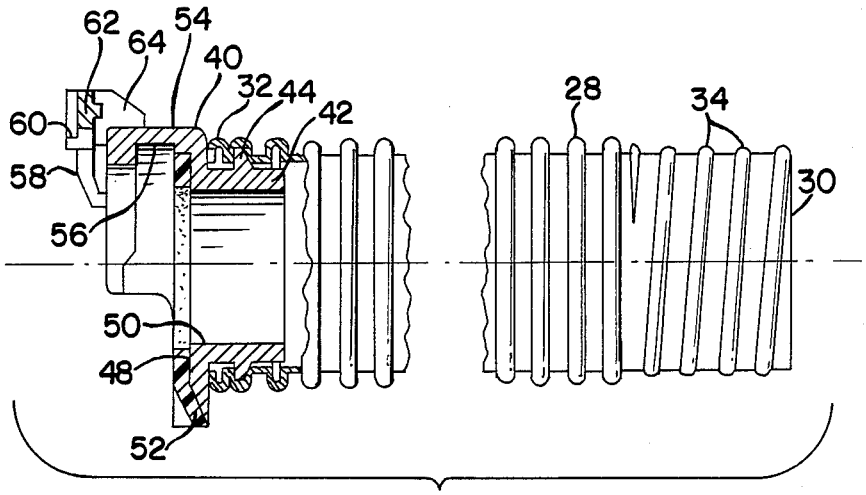
FIG. 5 shows the inventive assembly of the hose and connector, partially in cross-section.

FIG. 2 illustrates the underside of the head portion 10 and the rear of the dirt collecting portion 12. Visible on the underside of the head portion 10 is a cover 22 for the fan discharge port and visible on the rear of the dirt collecting portion 12 is a cover 24 for the dirt collecting portion intake duct 25. The dirt collecting portion 12 is formed with a trough 26 which contains a hose 28 extending from the fan discharge port to the intake port of the dirt collecting portion. As is shown in FIG. 5, the hose 28 has a first end 30 and a second end 32. The hose is formed with an external spiral rib 34 extending from the first end 30. The intake duct 25 of the dirt collecting portion, hidden by the cover 24, is generally cylindrical and is internally threaded. The spiral rib 34 on the hose 28 is of the same pitch as the internal threads of the intake duct 25 and extends a sufficient distance from the end 30 for matingly engaging the internal threads of the intake duct 25. The remainder of the hose 28 from the end of the spiral rib 34 to the second end 32 is formed as an undulated bellows to allow the hose 28 to be flexible for bending and to be able to change in length sufficiently to accommodate pivoting movement of the dirt collecting portion 12 relative the cleaner head portion 10 which results in a change in the spacing between the intake port and the fan discharge port.

Figure 4:
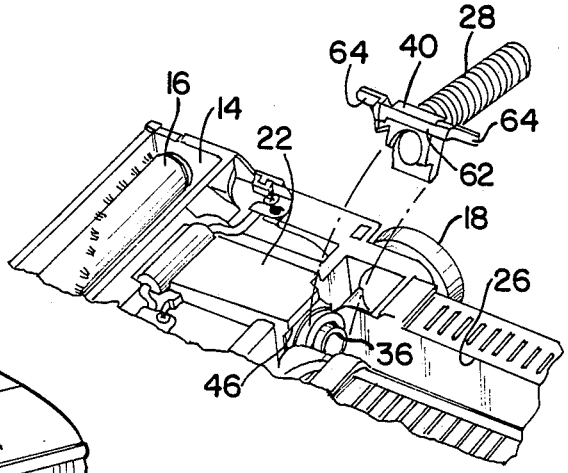
FIG. 4 is a partial perspective view similar to FIG. 3 and showing the inventive assembly separated from the fan discharge port.
Figure 8:
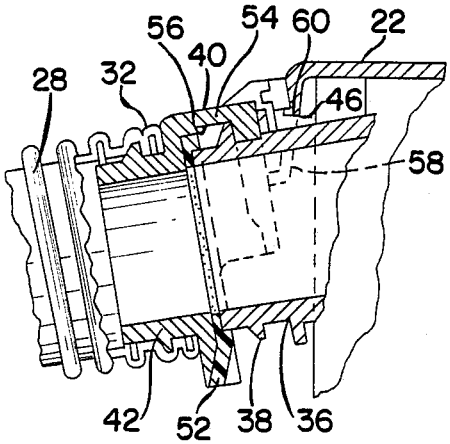
FIG. 8 is a cross-sectional view taken along the line 8—8 in FIG. 3.

As is shown in FIG. 4, the fan discharge port of the cleaner head portion 10 terminates in a tube stub 36. As is shown in FIG. 8, the tube stub 36 is formed with a circumferential rib 38. In the vacuum cleaner disclosed in the aforereferenced patent, the second end 32 of the hose 28 is forced over the tube stub 36 so that the rib 38 engages one of the bellows undulations to secure the hose thereto. As discussed above, this arrangement for connecting the hose proved to be unsatisfactory because it was difficult for the operator to remove and reinstall the hose in the event of a blockage therein.

According to the present invention, there is provided a connector 40 mounted on the second end 32 of the hose 28. The connector 40 includes a hollow cylindrical stub portion 42 having an external circumferential rib 44. The external dimensions of the stub portion 42 and the rib 44 are substantially the same as that of the discharge tube stub 36 and circumferential rib 38 so that the second end 32 of the hose 28 may be installed over the stub portion 42 of the connector 40 with the circumferential rib 44 engaging a bellows undulation of the hose 28 to secure together the hose 28 and the connector 40. This connection between the hose 28 and the connector 40 allows relative rotation between these two elements about their common longitudinal axis. For removably securing the hose 28 to the cleaner head portion 10 to provide fluid communication from the fan discharge tube stub 36 to the hose 28, there is provided a latching means which allows the operator to easily remove and install the hose. This latching means includes elements already part of the vacuum cleaner structure as well as elements formed as part of the connector 40. Those parts which are already part of the vacuum cleaner are the circumferential rib 38 on the discharge tube stub 36 and a shoulder 46 which is part of the cover 22. The connector 40, as will be described in full detail hereinafter, is provided with a groove for engaging the rib 38 and a detent cooperating with the shoulder 46. The groove allows transverse movement of the connector 40 relative to the tube stub 36 during removal and installation of the hose 28. After installation, the groove prevents axial movement and the detent inhibits transverse movement.

The connector 40 is formed with a flat face portion 48 attached to the stub portion 42 and lying substantially in a plane transverse to the axis of the stub portion 42. The face portion 48 has an opening 50 communicating with the interior of the stub portion 42. A gasket 52 covers the face portion 48 while leaving the opening 50 exposed. As is clear from FIG. 8, the gasket 52 sealingly engages the end of the discharge tube stub 36 when the connector 40 is installed thereon.

Figure 7:
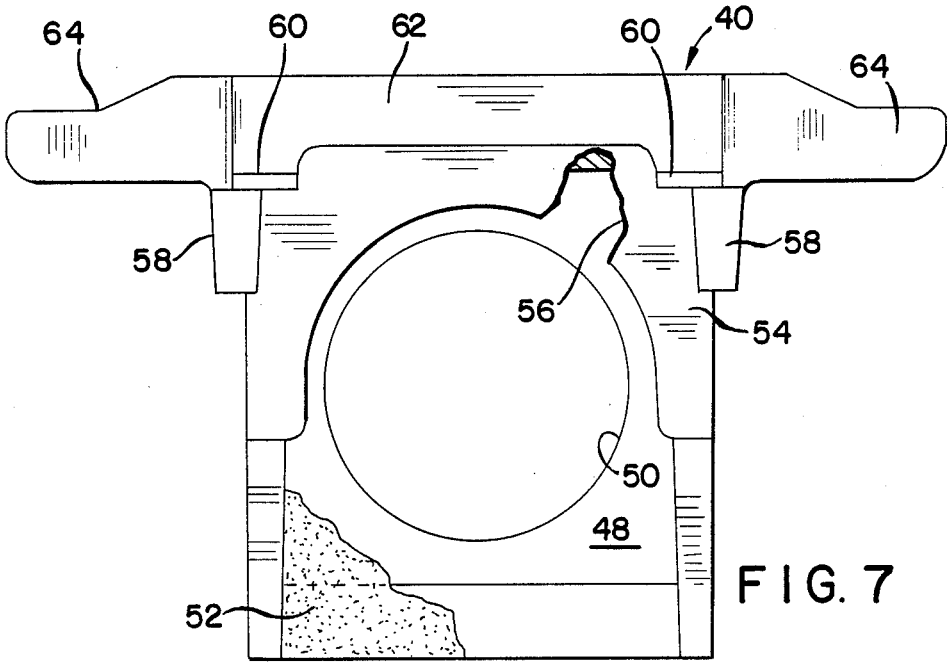
FIG. 7 is a front elevation, partially cut away, of the connector according to this invention.

The connector 40 is also formed with a hood 54 which extends from the face portion 48 away from the stub portion 42. The hood 54 is formed with a groove 56 therein. As is clear from FIG. 7, the hood 54 encompasses only about 180° of the periphery of the opening 50. Accordingly, the connector 40 may be moved in a direction transverse to the longitudinal axis of the discharge tube stub 36 with the rib 38 of the stub 36 within the groove 56 and the end of the stub 36 sealingly engaging the gasket 52. With the rib 38 within the groove 56, axial movement of the connector 40 relative the discharge tube stub 36 is prevented, while the aforedescribed transverse movement is allowed.

Figure 3:
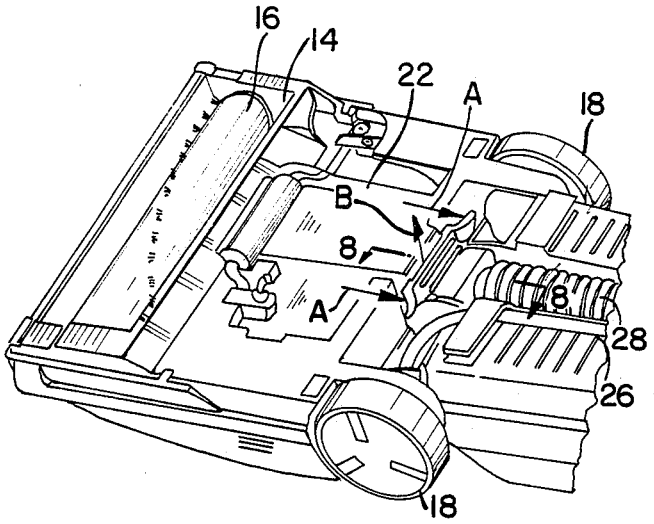
FIG. 3 is a partial perspective view of the underside and rear of the vacuum cleaner showing the connector installed on the fan discharge port.
Figure 6:
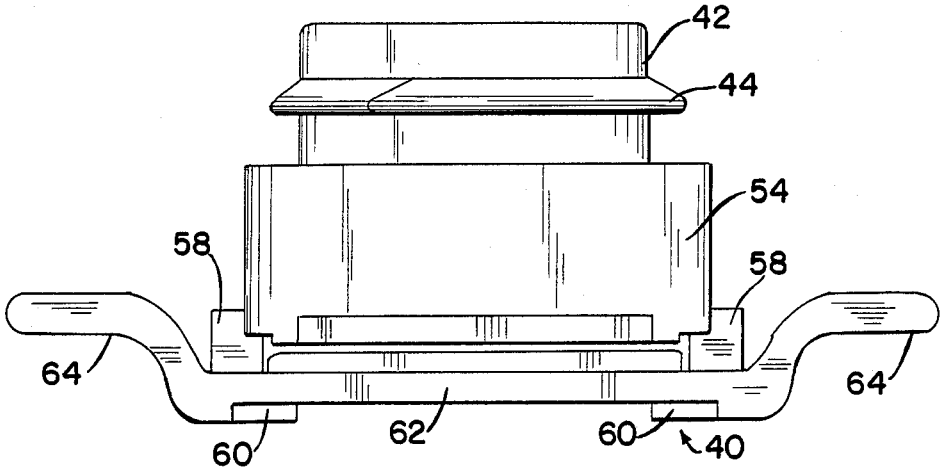
FIG. 6 is a top plan view of the connector according to this invention.

To cooperate with the shoulder 46 so as to prevent transverse movement of the connector 40 relative the discharge tube stub 36 when the tube stub 36 is in fluid communication with the connector stub portion 42, the connector 40 is formed with detent means which includes a pair of resilient arms 58 extending in parallel spaced relationship away from the hood 54. As is clear from FIG. 5, the arms 58 initially extend parallel to the axis of the stub portion 42 and then turn away from the axis so as to be substantially parallel to the face portion 48. At their distal ends, the arms 58 have formed thereon a pair of lips 60. The lips 60 are so shaped that they cooperate with the corners of the shoulder 46 to provide interfering contact for preventing transverse movement of the connector 40 after it is mounted on the tube stub 36. The lips 60 are connected together by a bar 62. A pair of tabs 64 are mounted one on each of the arms 58 and extend outwardly away from the bar 62. These tabs 64 are for the purpose of allowing an operator to apply pressure thereto for resultant resilient movement of the arms 58 to move the lips 60 out of interfering contact with the shoulder 46 so that the connector 40 can be moved away from the tube stub 36. Accordingly, as is clearly shown in FIGS. 3 and 6, the tabs 64 are curved to provide room for the fingers of the operator.

To install the hose 28 on the vacuum cleaner, initially the end 30 is threaded into the dirt collecting intake duct 25. Then, the lower end of the face portion 48 of the connector 40 is placed adjacent the end of the discharge tube stub 36, with the gasket 52 therebetween. The connector 40 may be rotated relative the hose 28 to obtain proper alignment thereof without unthreading the other end of the hose 28 from the intake duct 25. As is clear from FIG. 5, this lower end of the face portion 48 is angled slightly away from the tube stub 36 to assist in the installation. The connector 40 is then moved downwardly transverse to its longitudinal axis so that the rib 38 goes into the groove 56. This downward movement continues until the connector 40 has been moved sufficiently that the lips 60 snap into place, due to the resiliency of the arms 58, underneath the shoulder 46. FIG. 8 illustrates the positions of the elements at this time. When it is desired to remove the hose, the operator applies pressure to the tabs 64 in the direction shown by the arrows A in FIG. 3 to move the lips 60 out of interfering contact with the shoulder 46 and then lifts the connector 40 in the direction shown by the arrow B in FIG. 3 to cause transverse movement of the connector 40. The end 34 of the hose 28 is then unthreaded from the dirt collecting portion intake duct 25.

Accordingly, there has been disclosed an improved upper hose assembly for an upright vacuum cleaner. It is understood that the above-described embodiment is merely illustrative of the application of the principles of this invention. Numerous other embodiments may be devised by those skilled in the art without departing from the spirit and scope of this invention, as defined by the appended claims.

We claim:

1. In a vacuum cleaner having a cleaner head portion with a rigid fan discharge tube stub and a dirt collecting portion with an internally threaded intake duct, an assembly for providing fluid communication between said discharge tube stub and said intake duct comprising:

an elongated flexible hose having a first end and a second end, said hose being formed with an external spiral rib extending from said first end a sufficient distance and of appropriate pitch to act as an external thread for matingly engaging said first end of said hose with said intake duct, said hose being further formed as an undulating bellows from the end of said spiral rib to said hose second end;

a connector mounted on said hose second end, said connector being formed of a plastic material and having a hollow cylindrical stub portion sized to fit within said hose second end and an external circumferential rib on said stub portion for engaging a bellows undulation so as to secure said stub portion within said hose; and latching means for removably securing said connector to said cleaner head portion so that said fan discharge tube stub is in fluid communication with said connector stub portion.

2. The assembly according to claim 1 wherein said latching means includes:

a circumferential rib on said fan discharge tube stub;

a shoulder formed on said head cleaner portion adjacent said fan discharge tube stub;

groove means formed on said connector for engaging said circumferential rib of said fan discharge tube stub so as to allow transverse movement of said connector relative said fan discharge tube stub while preventing axial movement of said connector relative said fan discharge tube stub when said fan discharge tube stub is in fluid communication with said connector stub portion; and detent means formed on said connector for cooperating with said shoulder to inhibit said transverse movement when said fan discharge tube stub is in fluid communication with said connector stub portion.

3. The assembly according to claim 2 wherein said detent means is formed as an integral part of said connector.

4. The assembly according to claim 3 wherein said detent means is cantilevered from a main body portion of said connector.

5. The assembly according to claim 4 wherein said detent means includes:

a pair of resilient arms extending in parallel spaced relationship away from said main body portion;

a pair of lips, one on the distal end of each of said arms, said lips being shaped for interfering contact with said shoulder;

a bar connecting said lips; and a pair of tabs, one on each of said arms, and directed outwardly away from said bar for operator influenced resilient movement of said arms to move said lips out of interfering contact with said shoulder.

6. The assembly according to claim 2 wherein said connector further comprises:

a flat face portion attached to said stub portion ad lying substantially in a plane transverse to the axis of said stub portion, said face portion having an opening communicating with the interior of said stub portion, said opening being smaller than the exterior of said fan discharge tube stub;

a gasket surrounding said opening and covering said face portion for sealingly engaging the end of said fan discharge tube stub; and a hood extending from said face portion away from said stub portion, said hood having said groove means thereon.

7. The assembly according to claim 6 wherein said detent means includes:

a pair of resilient arms extending in parallel spaced relationship away from said hood;

a pair of lips, one on the distal end of each of said arms, said lips being shaped for interfering contact with said shoulder;

a bar connecting said lips; and a pair of tabs, one on each of said arms, and directed outwardly away from said bar for operator influenced resilient movement of said arms to move said lips out of interfering contact with said shoulder.

8. The assembly according to claim 6 wherein said hood encompasses about 180° of the periphery of said opening and said face portion is angled toward said stub portion in a region outside that encompassed by said hood.

* * * * *